US008418414B2

(12) United States Patent
Nelson

(10) Patent No.: US 8,418,414 B2
(45) Date of Patent: Apr. 16, 2013

(54) SWIMMING POOL BRACE ASSEMBLY

(75) Inventor: Laurence A. Nelson, Knoxville, TN (US)

(73) Assignee: P.I. Inc., Athens, TN (US)

( * ) Notice: Subject to any disclaimer, the term of this patent is extended or adjusted under 35 U.S.C. 154(b) by 26 days.

(21) Appl. No.: 12/617,835

(22) Filed: Nov. 13, 2009

(65) Prior Publication Data

US 2010/0126085 A1 May 27, 2010

Related U.S. Application Data

(60) Provisional application No. 61/114,117, filed on Nov. 13, 2008.

(51) Int. Cl.
*E04B 1/00* (2006.01)
*E02D 27/00* (2006.01)

(52) U.S. Cl.
USPC ..... 52/169.8; 52/584.1; 4/503; 4/506; 249/DIG. 3; 248/315

(58) Field of Classification Search ..... 52/169.7, 52/169.8, 169.9, 84.1, 169.1, 584.1, 146, 52/247, 656.1, 656.9, 567, 245, 631, 582.2; 4/506, 513, 487, 488; 403/401, 402, 403; 249/196, DIG. 3; 248/313, 315, 316.1
See application file for complete search history.

(56) References Cited

U.S. PATENT DOCUMENTS 3,440,780 A * 4/1969 West et al. ..... 52/169.7
3,905,570 A * 9/1975 Nieuwveld ..... 248/71
3,913,187 A * 10/1975 Okuda ..... 24/484
4,118,809 A * 10/1978 Bertsch ..... 52/149
4,124,907 A * 11/1978 Laven ..... 52/169.7
4,232,491 A * 11/1980 Bumgarner, Sr. ..... 52/169.7
4,464,802 A * 8/1984 Glonek et al. ..... 4/506
4,548,005 A * 10/1985 Glonek et al. ..... 52/155
4,566,660 A * 1/1986 Anscher et al. ..... 248/74.2
4,781,000 A * 11/1988 Bertsch et al. ..... 52/169.8
5,025,601 A * 6/1991 Hand ..... 52/169.7
5,098,054 A * 3/1992 Dyer ..... 248/313
5,108,054 A * 4/1992 Degand ..... 248/50
5,503,353 A * 4/1996 Degand ..... 248/50
5,941,030 A * 8/1999 Williamson ..... 52/182
7,412,802 B2 * 8/2008 Kantor ..... 52/169.8

* cited by examiner

*Primary Examiner* — William Gilbert
*Assistant Examiner* — Chi Q Nguyen
(74) *Attorney, Agent, or Firm* — Barnes & Thornburg LLP; Mark J. Nahnsen

(57) ABSTRACT

A swimming pool brace assembly having a brace and bracket used to attach a concrete form. The bracket positions the concrete form between the concrete footing and the deck of the swimming pool. The swimming pool brace is provided with receptacles that are adapted to receive the brackets, which are used to retain the position of the concrete form. The receptacles of the brace allow the brackets to be attached to either side of the brace. The bracket includes a retention feature that is configured to retain the bracket in position once inserted into the receptacle of the brace. The bracket includes a series of radially spaced inwardly extending protrusions that engage the concrete form. The protrusions are adapted to deflect to adjust for variations in the size of the forms.

14 Claims, 5 Drawing Sheets

SWIMMING POOL BRACE ASSEMBLY

The present application claims priority to U.S. Provisional Patent Application Ser. No. 61/114,117 filed on Nov. 13, 2008, which is herein incorporated by reference.

BACKGROUND

The present disclosure relates to braces, and particularly to braces used in swimming pool construction. More particularly, the present disclosure relates to a swimming pool brace that incorporates a means to attach a concrete form to the brace.

SUMMARY

According to the present disclosure, a swimming pool brace is adapted to receive a bracket to attach a concrete form. The bracket positions the concrete form between the concrete footing and the deck of the swimming pool.

In illustrative embodiments the swimming pool brace is provided with receptacles that are adapted to receive brackets, which are used to retain the position of the concrete form. The concrete form is a tubular structure that is positioned by sliding the form through the brackets. The receptacles of the brace allow the brackets to be attached to either side of the brace.

In illustrative embodiments, the bracket is configured to position the bracket at a certain distance relative to the brace. The bracket includes a feature that is controls the depth of the placement in the brace receptacle. The bracket also includes a retention feature that is configured to retain the bracket in position once inserted into the receptacle. The bracket includes a series of radially spaced inwardly extending protrusions that engage the concrete form. The protrusions are adapted to deflect to adjust for variations in size of the forms.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
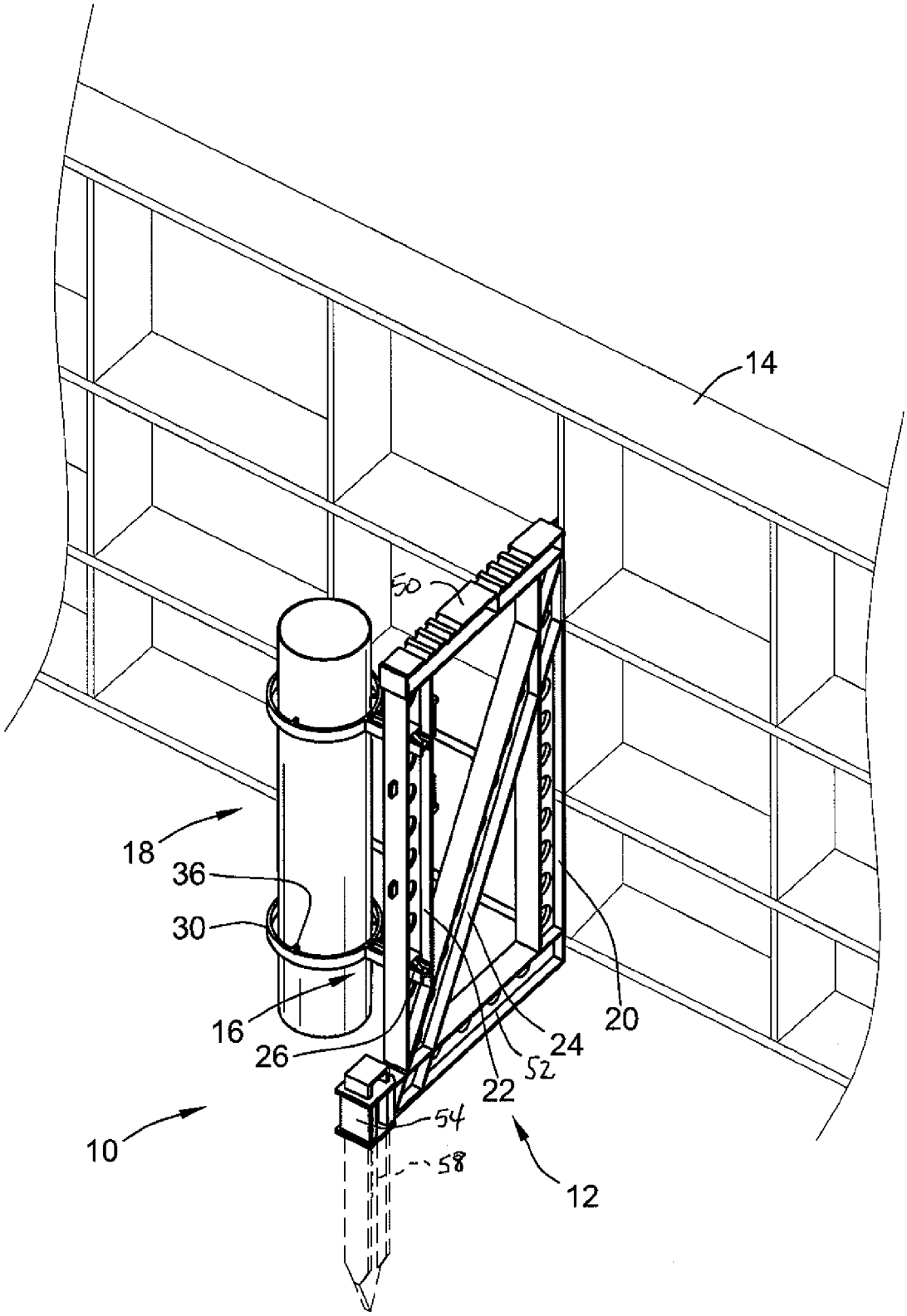
FIG. 1 is a perspective view of the side wall of a pool having a pool brace secured to the side wall of the pool, the pool brace with the brackets inserted and a concrete form inserted within the brackets.

While the present disclosure may be susceptible to embodiment in different forms, there are shown in the drawings, and herein will be described in detail, embodiments with the understanding that the present description is to be considered an exemplification of the principles of the disclosure and is not intended to limit the disclosure to the details of construction and the arrangements of components set forth in the follow description or illustrated in the drawings.

Conventional pool braces do not provide for a method of positioning a concrete form between the concrete foundation or collar pour and the concrete deck surrounding the swimming pool. Conventional pool braces do not provide for a means for positioning the concrete form to either side of the brace and do not provide for adjustment of the relationship between the foundation or collar pour and the concrete deck. The concrete form is used to form concrete columns, which support the concrete decking surrounding the pool to prevent the concrete decking from collapsing or sinking.

The swimming pool brace assembly 10 not only maintains the orientation of the pool wall section 14, it allows for the proper positioning of the concrete form so that concrete can be poured to form the columns used to support the concrete deck that surrounds the finished pool. Once the pool wall sections 14, brace assemblies 10 and concrete forms are properly positioned, the concrete is poured to secure the braces 10 and fill the tubular posts. Once completed, the braces and concrete supports are backfilled with dirt and a concrete deck is poured.

The swimming pool brace assembly 10 comprises a pool brace 12 used to reinforce and locate a pool wall 14, as shown in FIG. 1. The pool brace assembly 10 is used for the construction of the pool and is completely covered by backfill (dirt) and a concrete deck when the pool is completely installed. The brace assembly 10 also includes concrete form brackets 16 that interface with a concrete form 18 to position the form 18 in relation to the brace 12. The brackets 16 also allow for vertical adjustment of the concrete form with respect to the brace 12. The concrete form 18 is slideably engaged within the brackets 16, which also allows for changes in the length of the concrete form 18.

The brace 12 includes first and second vertical supports 20, 22 interconnected by a diagonal reinforcement member 24. The first vertical support 20 is adapted to be coupled to the pool wall 14. The second vertical support 22 is spaced from the first vertical support and includes a pair of receptacles 26. The receptacles 26 are in the form of slots that are adapted to accept one end of the brackets 16.

The first vertical support 20 of brace 12 is of an I-beam configuration and includes a first wall 40 and a spaced apart second wall 42 that is coupled to the first wall 40 by web 44. First wall 40 includes a series of flanges 46 that are formed to include openings 48 that are configured to accept fasteners to couple pool wall section to brace 12. Web 44 of first vertical support 20 also includes a series of apertures that assist in retaining the position of the brace when backfill is applied.

First vertical support 20 is coupled to second vertical support 22 by use of top support 50 and spaced apart bottom support 52. Bottom support 52 extends past second vertical support 22 and includes spike collar 54. Spike collar 54 includes opening 56 that is configured to accept spike 58. Spike 58 is inserted into spike collar 54 and is driven into the soil by use of a rubber mallet to secure the position of the brace assembly 10 before pouring the concrete. Spike 58, in the illustrative embodiment, is molded with brace 12 and coupled by frangible connectors. Spike 58 is broken away from brace 12 during installation of brace 12. While a spike is shown, other types of retainers can be used to secure the brace 12.

Second vertical support 22 includes a first wall 60 and a second wall 62 that is coupled to the first wall 60 by web 64. Web 64 is provided with receptacles 26 that are configured to accept brackets 16, which are used to support concrete form 18. Receptacles 26 are formed to include an opening that allows for the insertion of part of support arm 28 into receptacle 26. Receptacles 26 include four walls 66 that form a box. Walls 66 assist in maintaining the orientation of the bracket 16 to prevent unwanted movement.

Figure 2:
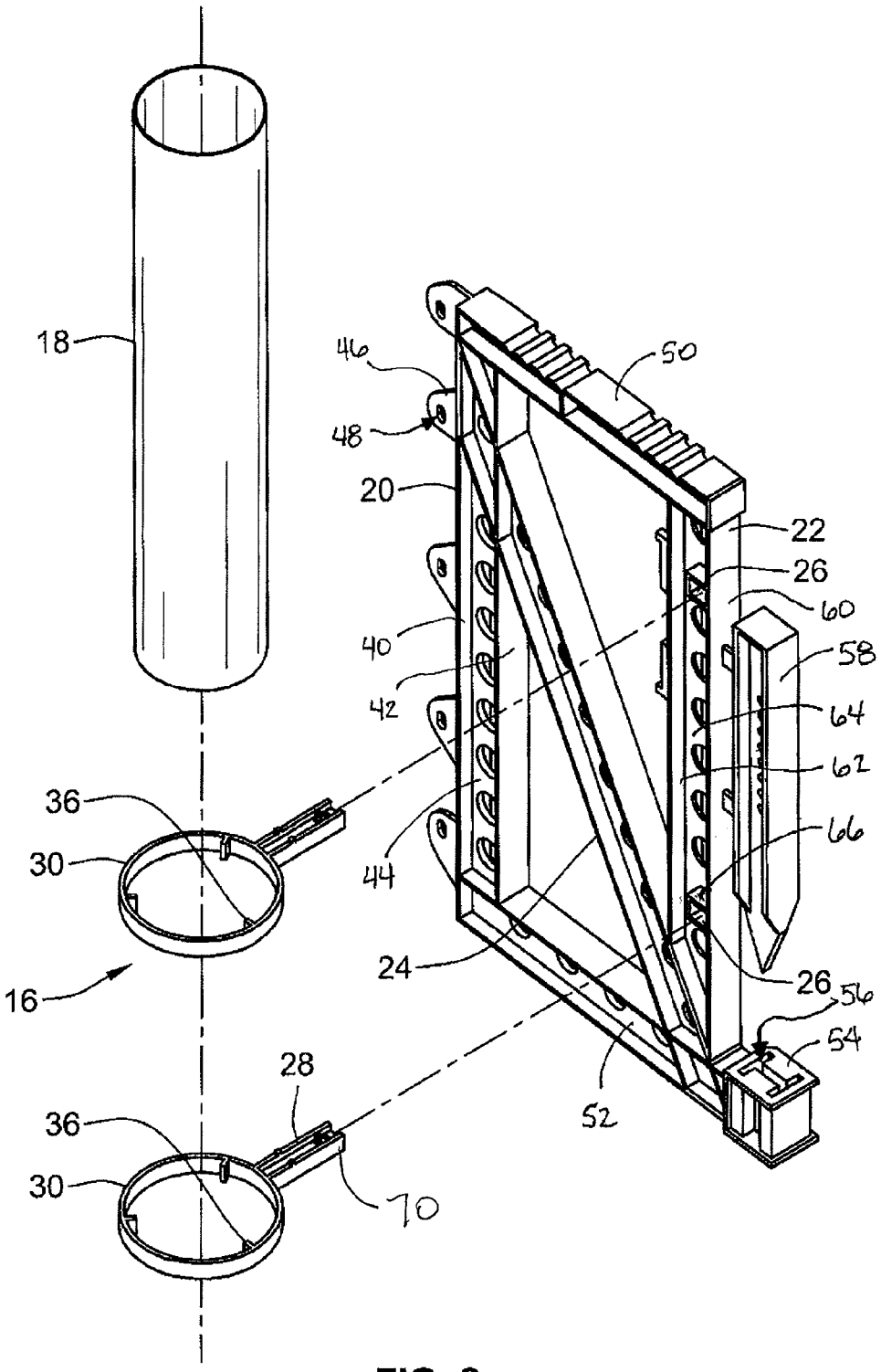
FIG. 2 is an exploded perspective view showing the brace with the brackets aligned with receptacles of the brace and the concrete form aligned with the brackets.
Figure 3:
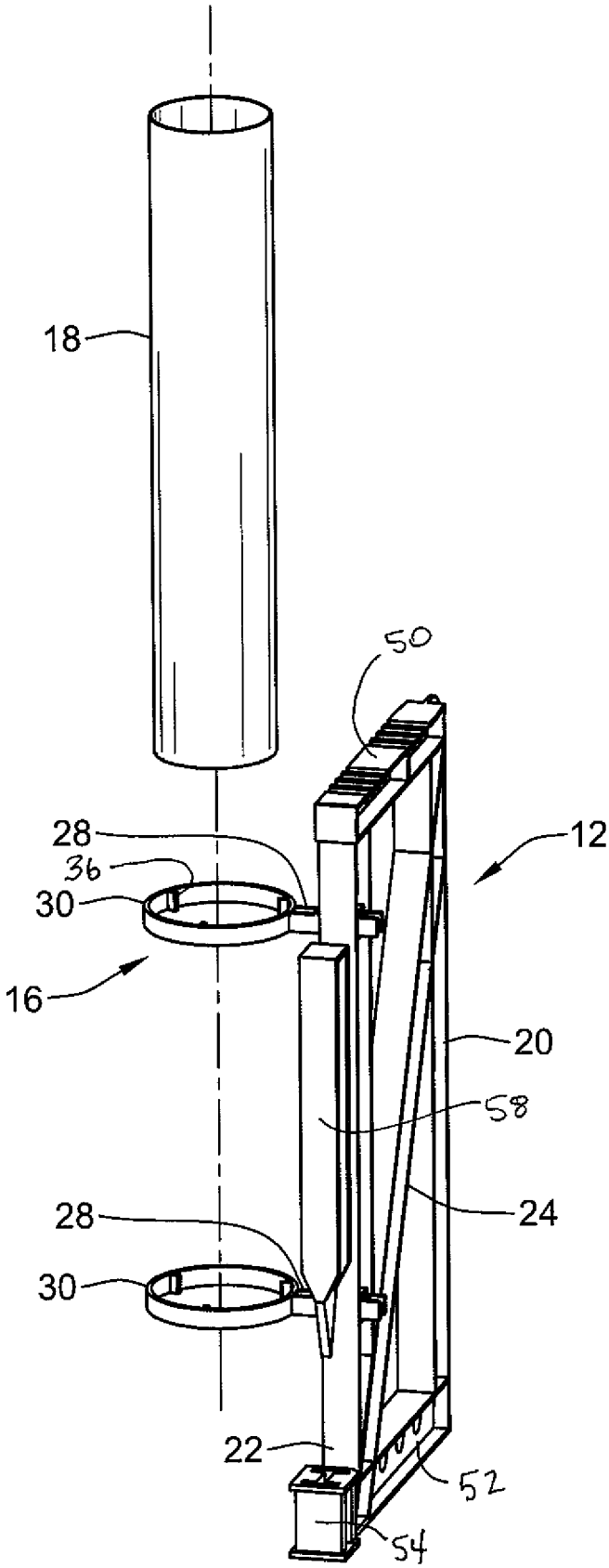
FIG. 3 is an exploded perspective view showing the brackets inserted into the receptacles of the brace and the concrete form aligned with the brackets.

The bracket 16 includes support arm 28 and a tube ring 30 that is coupled to a first end 68 of the support arm 28, as shown in FIG. 2. The support arm 28 is adapted to be coupled to the receptacles 26 of brace 12 at a second end 70. Support arm 28 includes two parallel walls 72, 74 and a perpendicular wall 76 positioned between the parallel walls 72, 74.

Figure 4:
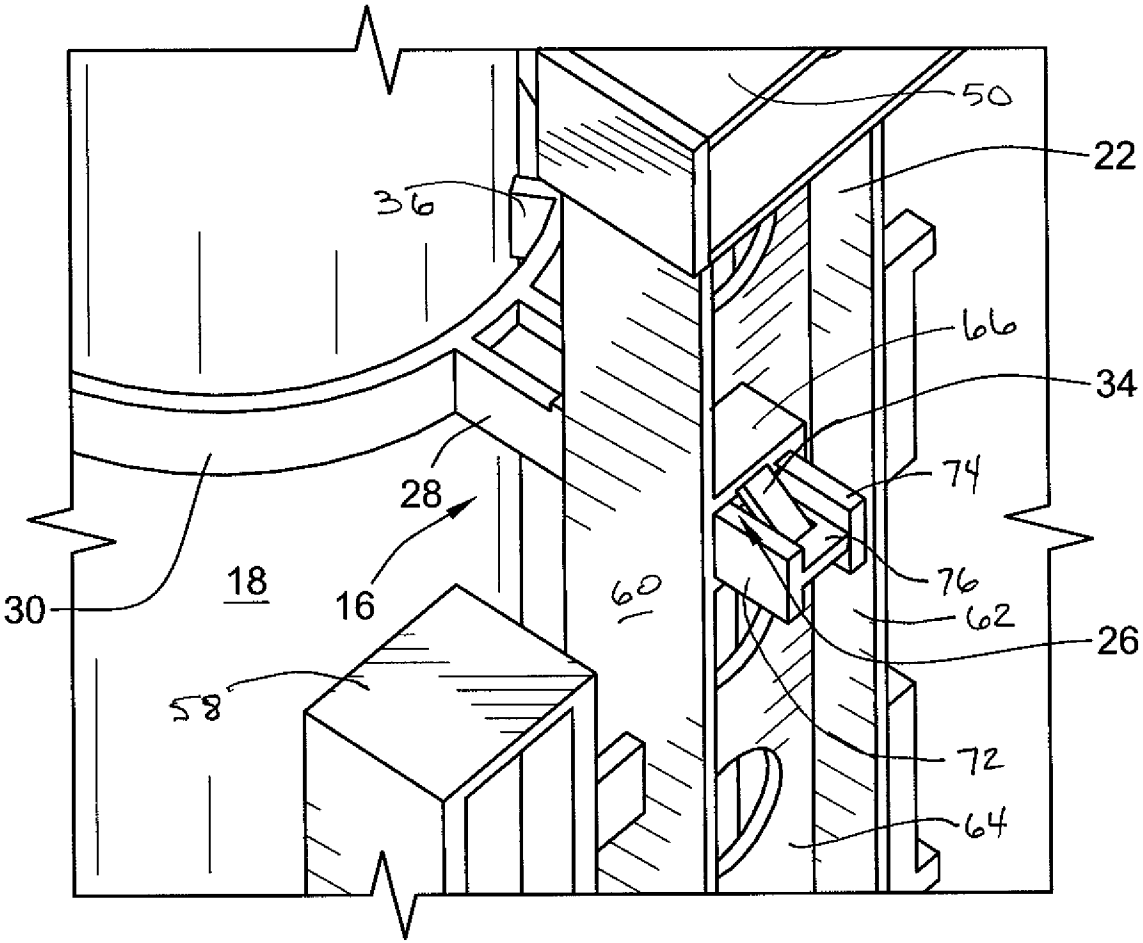
FIG. 4 is a perspective view of the retention means of the bracket cooperating with the brace receptacle.
Figure 5:
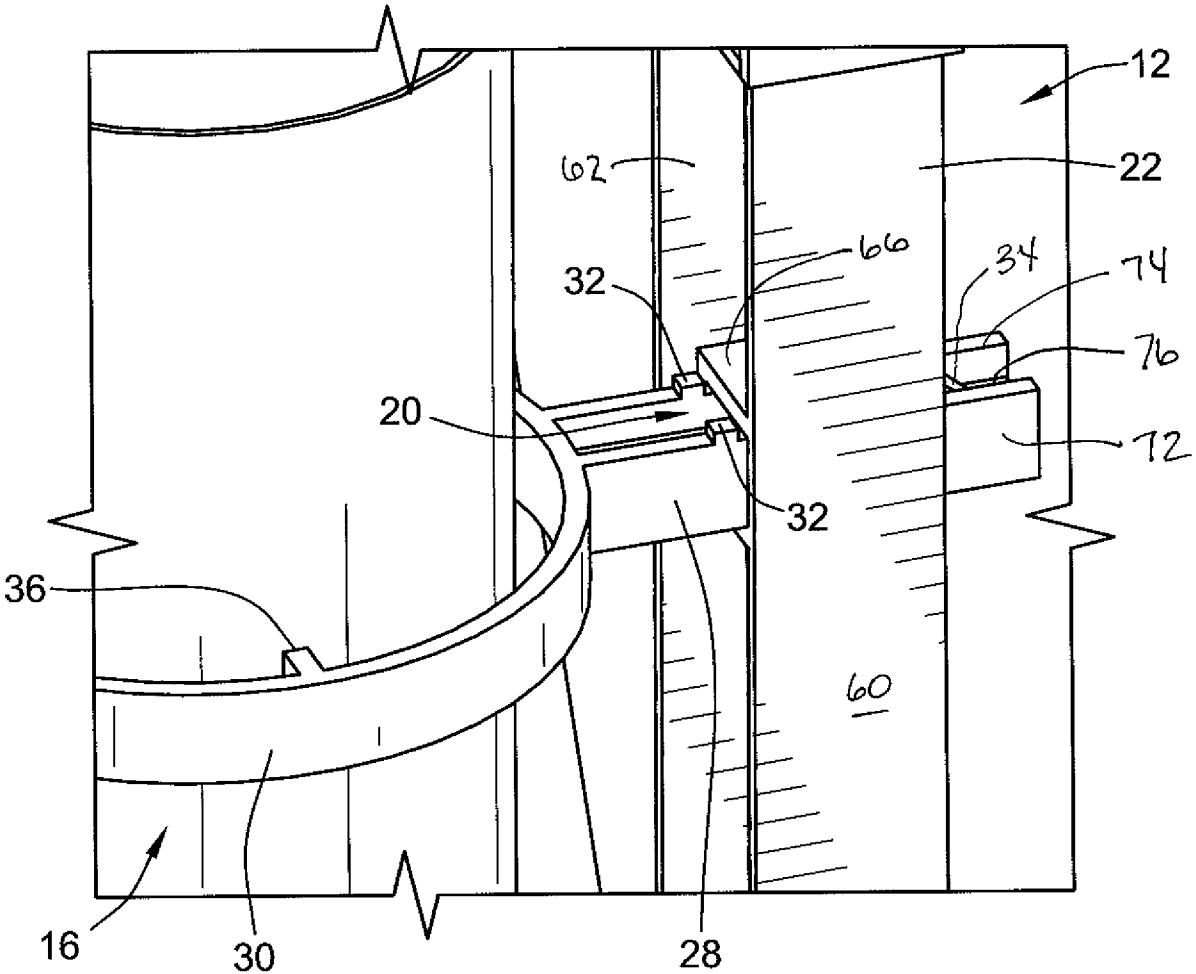
FIG. 5 is a perspective view showing the feature used to position the bracket relative to the brace and also showing the protrusion that forms the deformable detail cooperating with the concrete form.

Support arm 28 includes a pair of stops 32 formed on the parallel walls 72, 74 that are configured to limit how far the support arm 28 can be inserted into the receptacles 26 of the support brace 12, as shown in FIG. 5. While a rectangular shaped support arm is shown, it is contemplated that other shapes could also be used including round, triangular, elliptical, etc. The support arm 28 also includes a sloped retainer 34 that is biased outwardly from the support arm 28, as shown in FIG. 4. The retainer 34 is adapted to be compressed as the retainer 34 passes through the receptacle 26 and spring back to an extended position to lock the support arm 28 or bracket 16 within receptacle 26 of brace 12. Once the retainer 34 passes through the receptacle 26 it cannot be removed without first depressing the retainer 34 toward the support arm 28.

The tube ring 30 is coupled to the support aim 28 and adapted to retain the position of the concrete form 18. While a circular tube ring 30 is used, it is contemplated that other shaped tube rings could also be used, including square, triangular, etc. Tube ring 30 includes a series of radially spaced and inwardly extending protrusions 36 that are configured to engage the concrete form 18. The protrusions 36 are adapted to deflect to adjust for variations in size of forms 18. The bracket 16 is preferably made from a plastics material by injection molding but can be made from other materials, such as metal. Since the receptacle 26 passes and extends through the web 64 second vertical support 22 of the brace 12, the bracket 16 can be coupled to either side of the brace 12.

In use, an installer, after assembly of the pool walls 25 with braces 12, inserts the brackets 16 into the receptacles 26 from either side of the brace 12. Once the brackets 16 are in position, the installer inserts the concrete form 18 through the tube ring 30 of the brackets 16 down to the level of the concrete foundation or collar pour positioned at the base of the braces 12. After the concrete foundation or collar pour is complete, backfill is added up to the top of the concrete form 18 and the concrete deck of the pool is poured. The concrete form is also filled with concrete to form a support between the concrete foundation and deck surrounding the pool.

While embodiments have been illustrated and described in the drawings and foregoing description, such illustrations and description are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as constraining or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A pool wall brace assembly for supporting a portion of an in-ground pool wall comprising:

a brace having a first end configured to be coupled to the pool wall, the brace configured to assist in maintaining a position of the pool wall prior to backfilling behind the pool wall, the brace further having a first side and a second side;

a bracket having a first end configured to be coupled to either the first side or the second side of the brace and includes a support arm that is configured to extend outwardly from and generally perpendicular to the brace when coupled thereto;

the bracket includes a concrete form support ring, that is coupled to one end of the support arm, the support ring including a series of deflectable support members used to engage and retain the position of a concrete form with respect to the support ring to allow concrete to be poured into the concrete form, the concrete form support ring also configured to allow the concrete form to slide vertically within the support ring to permit vertical adjustment of the concrete form, with respect to the bracket; and wherein the brace and bracket are covered with backfill after the concrete is poured into the concrete form.

2. The pool wall brace assembly of claim 1, wherein the brace further includes first and second vertical supports interconnected by a reinforcing member.

3. The pool wall brace assembly of claim 1, wherein the brace includes a receptacle that is configured to accept the support arm to allow the bracket to extend horizontally from the first or second side of the brace.

4. The pool wall brace assembly of claim 3, wherein the support arm includes a stop that limits how far the support arm can be inserted into the receptacle.

5. The pool wall brace assembly of claim 4, wherein the support arm includes a retainer that is configured to prevent unwanted removal of the support arm from the bracket.

6. The pool wall brace assembly of claim 5, wherein the retainer is biased outwardly from the support arm and is configured to pass through the receptacle and spring open to lock the bracket to the brace.

7. A pool wall brace assembly for supporting a portion of an in-ground pool wall comprising:

a brace having a first end configured to be coupled to the pool wall and configured to maintain a position of the pool wall prior to backfilling around the pool wall the brace further having a first side and a second side;

a bracket having a first end configured to be coupled to either the first side or the second side of the brace and includes a support arm that is configured to extend outwardly from and generally perpendicular to the brace, the bracket configured to include a concrete form support ring, that is coupled to the support arm, the support ring including a series of deflectable support members used to engage and retain the position of a concrete form, the concrete form support ring also configured to allow the concrete form to slide within the support ring to permit vertical adjustment of the concrete form to allow concrete to be poured into the concrete form;

a collar coupled to the brace, the collar configured to accept a retainer that engages soil to assist in maintaining the position of the brace;

wherein the brace and bracket are covered with backfill after the concrete is poured into the concrete form.

8. The pool wall brace assembly of claim 7, wherein the brace further includes first and second vertical supports interconnected by a reinforcing member.

9. The pool wall brace assembly of claim 7, wherein the concrete form support is in the form of a support ring that is configured to be positioned around the concrete form.

10. The pool wall brace assembly of claim 9, wherein the support ring includes a series of radially spaced protrusions that extend inwardly to engage the concrete form.

11. The pool wall brace assembly of claim 10, wherein the protrusions are configured to deflect away from the concrete form to adjust for variations in the size of the concrete forms.

12. The pool wall brace assembly of claim 7, wherein the brace includes a receptacle that is configured to accept the support arm.

13. The pool wall brace assembly of claim 12, wherein the support arm includes a stop that limits how far the support arm can be inserted into the receptacle.

14. The pool wall brace assembly of claim 13, wherein the support arm includes a retainer that is configured to prevent unwanted removal of the support arm from the bracket.

* * * * *